US010615550B2

(12) United States Patent
Liu et al.

(10) Patent No.: US 10,615,550 B2
(45) Date of Patent: Apr. 7, 2020

(54) EARPHONE RECOGNITION AND CONNECTION METHODS AND CIRCUITS AND STORAGE MEDIUM

(71) Applicant: ZTE Corporation, Shenzhen, Guangdong (CN)

(72) Inventors: Fengpeng Liu, Shenzhen (CN); Dongmei Liu, Shenzhen (CN)

(73) Assignee: ZTE CORPORATION, Shenzhen, Guangdong (CN)

( * ) Notice: Subject to any disclaimer, the term of this patent is extended or adjusted under 35 U.S.C. 154(b) by 296 days.

(21) Appl. No.: 15/525,780

(22) PCT Filed: May 13, 2015

(86) PCT No.: PCT/CN2015/078862
§ 371 (c)(1),
(2) Date: May 10, 2017

(87) PCT Pub. No.: WO2016/074457
PCT Pub. Date: May 19, 2016

(65) Prior Publication Data

US 2019/0157822 A1 May 23, 2019

(30) Foreign Application Priority Data

Nov. 14, 2014 (CN) ..... 2014 1 0649924

(51) Int. Cl.
*H01R 24/58* (2011.01)
*H04R 1/10* (2006.01)
(Continued)

(52) U.S. Cl.
CPC ..... *H01R 24/58* (2013.01); *H04R 1/1041* (2013.01); *H04R 5/04* (2013.01); *H01R 2105/00* (2013.01); *H04R 2420/05* (2013.01)

(58) Field of Classification Search
CPC ..... H04R 24/58; H04R 1/1041; H04R 5/04; H01R 2105/00
See application file for complete search history.

(56) References Cited

U.S. PATENT DOCUMENTS 7,248,707 B2 7/2007 Peng
2012/0093328 A1 4/2012 Hsi
(Continued)

FOREIGN PATENT DOCUMENTS

CN 101431708 A 5/2009
CN 202425016 U 9/2012
(Continued)

OTHER PUBLICATIONS

International Search Report in international application No. PCT/CN2015/078862, dated Aug. 13, 2015, 3 pgs.
(Continued)

*Primary Examiner* — Regina N Holder
(74) *Attorney, Agent, or Firm* — Li & Cai Intellectual Property (USA) Office

(57) ABSTRACT

Disclosed is an earphone recognition method and circuit, an earphone connection method and circuit. When detecting an earphone is plugged, a circuit state between a sound channel area of the earphone and an adjacent area is detected; for a short-circuit state, it is determined the adjacent area is a GND area and another adjacent area of the GND area is an MIC area, and a first indication signal is output to connect the GND area and MIC area of the earphone with a GND end and MIC end of a system respectively; and for an open-circuit state, it is determined the adjacent area is the MIC area and another adjacent area of the MIC area is the GND area, and a second indication signal is output to connect the GND area and MIC area of the earphone with the GND end and MIC end of the system respectively.

10 Claims, 8 Drawing Sheets

(51) Int. Cl.
*H04R 5/04* (2006.01)
*H01R 105/00* (2006.01)

(56) References Cited

U.S. PATENT DOCUMENTS

| | | | |
|---|---|---|---|
| 2013/0114824 | A1 | 5/2013 | Wu |
| 2013/0279713 | A1 | 10/2013 | Xiao et al. |

FOREIGN PATENT DOCUMENTS

| | | | |
|---|---|---|---|
| CN | 202551149 | U | 11/2012 |
| CN | 102833649 | A | 12/2012 |
| CN | 103096210 | A | 5/2013 |
| CN | 103841494 | A | 6/2014 |
| CN | 103945317 | A | 7/2014 |
| EP | 2317743 | A1 | 5/2011 |
| WO | 2012031481 | A1 | 3/2012 |

OTHER PUBLICATIONS

English Translation of the Written Opinion of the International Search Authority in international application No. PCT/CN2015/078862, dated Aug. 17, 2015, 6 pgs.
Supplementary European Search Report in European application No. 15858628.9, dated Oct. 17, 2017, 11 pgs.

EARPHONE RECOGNITION AND CONNECTION METHODS AND CIRCUITS AND STORAGE MEDIUM

TECHNICAL FIELD

The disclosure relates to an earphone application technology, and more particularly to an earphone recognition method and circuit, an earphone connection method and circuit and a storage medium.

BACKGROUND

There are multiple earphone standards, mainly including two international standards: European standard earphones and American standard earphones, and the greatest difference between the two types of earphones is that the positions of the Grounding (GND) area and the Microphone (MIC) area on the two types of earphones are different from each other. All electronic devices supporting multimedia playing are required to be compatible with both European standard earphones and American standard earphones. In the current electronic devices, a microprocessor is usually adopted to recognize the type of an earphone. However, such a recognition circuit is complex in design, relatively higher in cost and poor in recognition accuracy.

SUMMARY

In order to solve the technical problem, an earphone recognition method and circuit, an earphone connection method and circuit and a storage medium are provided in embodiments of the disclosure.

The technical solutions of the embodiments of the disclosure are implemented as follows.

An earphone recognition method is provided, which may include:

when it is detected that an earphone is plugged, detecting a circuit state between a sound channel area of the earphone and an adjacent area of the sound channel area, determining that the earphone is of a first type when the circuit state between the sound channel area of the earphone and the adjacent area of the sound channel area is a short-circuit state, and determining that the earphone is of a second type when the circuit state between the sound channel area of the earphone and the adjacent area of the sound channel area is an open-circuit state.

As an implementation mode, the method may further include:

when the circuit state between the sound channel area of the earphone and the adjacent area of the sound channel area is the short-circuit state, determining that the adjacent area of the sound channel area is a GND area and another adjacent area of the GND area is a MIC area; and when the circuit state between the sound channel area of the earphone and the adjacent area of the sound channel area is the open-circuit state, determining that the adjacent area of the sound channel area is the MIC area and another adjacent area of the MIC area is the GND area.

As an implementation mode, the method may further include:

when the circuit state between the sound channel area of the earphone and the adjacent area of the sound channel area is the short-circuit state, outputting a first indication signal; and when the circuit state between the sound channel area of the earphone and the adjacent area of the sound channel area is the open-circuit state, outputting a second indication signal.

As an implementation mode, detecting the circuit state between the sound channel area of the earphone and the adjacent area of the sound channel area may include:

detecting a voltage between the sound channel area of the earphone and the adjacent area of the sound channel area to determine the circuit state between the sound channel area of the earphone and the adjacent area of the sound channel area; or detecting a current between the sound channel area of the earphone and the adjacent area of the sound channel area to determine the circuit state between the sound channel area of the earphone and the adjacent area of the sound channel area.

An earphone connection method is provided, which may include:

upon detecting that an earphone is plugged, detecting a circuit state between a sound channel area of the earphone and an adjacent area of the sound channel area;

when the circuit state between the sound channel area of the earphone and the adjacent area of the sound channel area is a short-circuit state, determining that the adjacent area of the sound channel area is a GND area and another adjacent area of the GND area is a MIC area, and outputting a first indication signal to cause the GND area and MIC area of the earphone to be connected with a GND end and MIC end of a system respectively; and when the circuit state between the sound channel area of the earphone and the adjacent area of the sound channel area is an open-circuit state, determining that the adjacent area of the sound channel area is the MIC area and another adjacent area of the MIC area is the GND area, and outputting a second indication signal to cause the GND area and MIC area of the earphone to be connected with the GND end and MIC end of the system respectively.

As an implementation, detecting the circuit state between the sound channel area of the earphone and the adjacent area of the sound channel area may include:

detecting a voltage between the sound channel area of the earphone and the adjacent area of the sound channel area to determine the circuit state between the sound channel area of the earphone and the adjacent area of the sound channel area; or detecting a current between the sound channel area of the earphone and the adjacent area of the sound channel area to determine the circuit state between the sound channel area of the earphone and the adjacent area of the sound channel area.

An earphone recognition circuit is provided, which may include a detection power supply, a first resistor, a second resistor and a third resistor, wherein the detection power supply, the first resistor, the second resistor and the third resistor may be sequentially connected in series, and the third resistor may be grounded; a sound channel area of an earphone may be connected to a circuit between the second resistor and the third resistor; an adjacent area of the sound channel area of the earphone may be connected to a circuit between the first resistor and the second resistor;

a resistance value of the second resistor may be higher than a resistance value of the first resistor, and the resistance value of the first resistor may be higher than a resistance value of the third resistor; the resistance value of the third resistor may be higher than n times of impedance of the earphone; n may be more than or equal to 10; and the earphone may be determined to be of a first type when the circuit between the first resistor and the second resistor is at a low level, and the earphone may be determined to be of a second type when the circuit between the first resistor and the second resistor is at a high level.

As an implementation, the circuit may include an indication signal output line;

one end of the indication signal output line may be connected to the circuit between the first resistor and the second resistor, and the other end may be an output end; and the output end may output a level signal of the circuit between the first resistor and the second resistor.

An earphone connection circuit is provided, which may include a detection circuit and a switching circuit, wherein the detection circuit may include a detection power supply, a first resistor, a second resistor, a third resistor and an indication signal output line, the detection power supply, the first resistor, the second resistor and the third resistor may be sequentially connected in series, and the third resistor may be grounded; a sound channel area of an earphone may be connected to a circuit between the second resistor and the third resistor; an adjacent area of the sound channel area of the earphone may be connected to a circuit between the first resistor and the second resistor;

a resistance value of the second resistor may be higher than a resistance value of the first resistor, and the resistance value of the first resistor may be higher than a resistance value of the third resistor; the resistance value of the third resistor may be higher than n times of impedance of the earphone; n may be more than or equal to 10;

the switching circuit may include an indication signal receiving line, a first switch and a second switch; one end of the first switch may be connected with a GND end of a system, and other ends of the first switch may be connected with a MIC area and GND area of the earphone respectively; one end of the second switch may be connected with a MIC end of the system, and other ends of the second switch may be connected with the MIC area and GND area of the earphone respectively;

one end of the indication signal output line may be connected to the circuit between the first resistor and the second resistor, another end of the indication signal output line may be connected with an input end of the indication signal receiving line, and an output end of the indication signal receiving line may be connected with the first switch and the second switch respectively;

when the circuit between the first resistor and the second resistor is at a low level, it may be determined that the adjacent area of the sound channel area is the GND area and another adjacent area of the GND area is the MIC area, the indication signal output line may output a low level signal to the indication signal receiving line, and the low level signal may control the first switch to gate the GND end of the system and the GND area of the earphone and control the second switch to gate the MIC end of the system and the MIC area of the earphone; and when the circuit between the first resistor and the second resistor is at a high level, it may be determined that the adjacent area of the sound channel area is the MIC area and another adjacent area of the MIC area is the GND area, the indication signal output line may output a high level signal to the indication signal receiving line, and the high level signal may control the first switch to gate the GND end of the system and the GND area of the earphone and control the second switch to gate the MIC end of the system and the MIC area of the earphone.

As an implementation mode, the earphone may be determined to be of a first type when the circuit between the first resistor and the second resistor is at a low level; and the earphone may be determined to be of a second type when the circuit between the first resistor and the second resistor is at a high level.

A storage medium is provided, in which a computer program may be stored, the computer program is arranged to execute the earphone recognition method.

A storage medium is provided, in which a computer program may be stored, the computer program is arranged to execute the earphone connection method.

In the embodiments of the disclosure, the GND area and MIC area of the earphone are determined by detecting the circuit state between the sound channel area and adjacent area of the earphone, and the GND area and MIC area of the earphone are butted with the GND end and MIC end of the earphone system in the electronic device respectively to make the earphone enter a working state. According to the embodiments of the disclosure, a simple detection circuit may determine whether the adjacent area of the sound channel area of the earphone is the GND area or the MIC area and accordingly output a corresponding control level to butt the GND area and MIC area of the earphone with the GND end and MIC end of the earphone system in the electronic device for normal working, and may take the place of an existing earphone recognition circuit including a microprocessor, so that cost of the earphone recognition circuit is reduced, and recognition accuracy is quite high.

DETAILED DESCRIPTION

In order to make the purpose, technical solutions and advantages of the disclosure clearer, the embodiments of the disclosure will be described below in detail with reference to the drawings. It is to be noted that the embodiments in the disclosure and characteristics in the embodiments may be freely combined under the condition of no conflicts.

Figure 1:
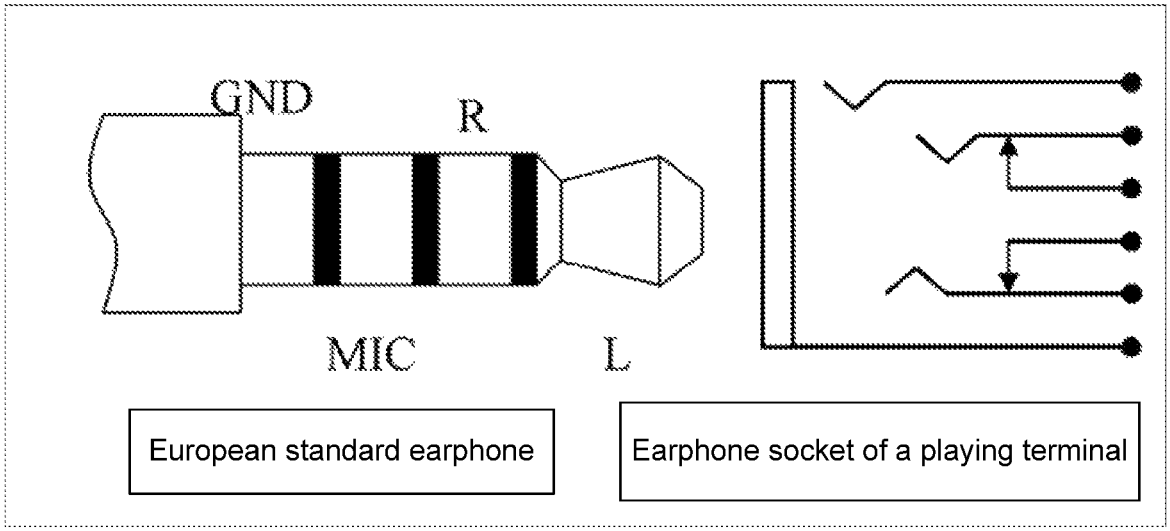
FIG. 1 is a schematic diagram of a plug of a European standard earphone according to an embodiment of the disclosure.
Figure 2:
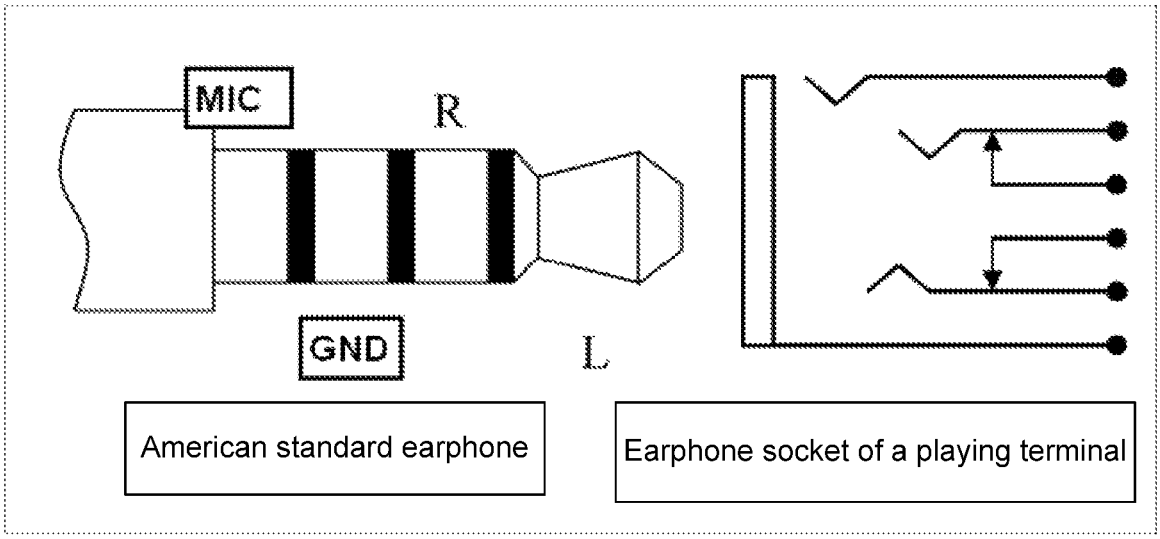
FIG. 2 is a schematic diagram of a plug of an American standard earphone according to an embodiment of the disclosure.

FIG. 1 is a schematic diagram of a plug of a European standard earphone according to an embodiment of the disclosure, and FIG. 2 is a schematic diagram of a plug of an American standard earphone according to an embodiment of the disclosure. As shown in FIG. 1 and FIG. 2, a main difference between the European standard earphone and the American standard earphone is that sequence of MIC area and GND area is different from each other. The GND area of the American standard earphone is adjacent to a sound channel area (a left sound channel L and a right sound channel R) of the earphone, and the MIC area is on a left side of the GND area; while the MIC area of the European standard earphone is adjacent to a sound channel area (a left sound channel L and a right sound channel R) of the earphone, and the GND area is on a left side of the MIC area. Positions of the sound channel areas of the European standard earphone and the American standard earphone are completely the same.

Figure 3:
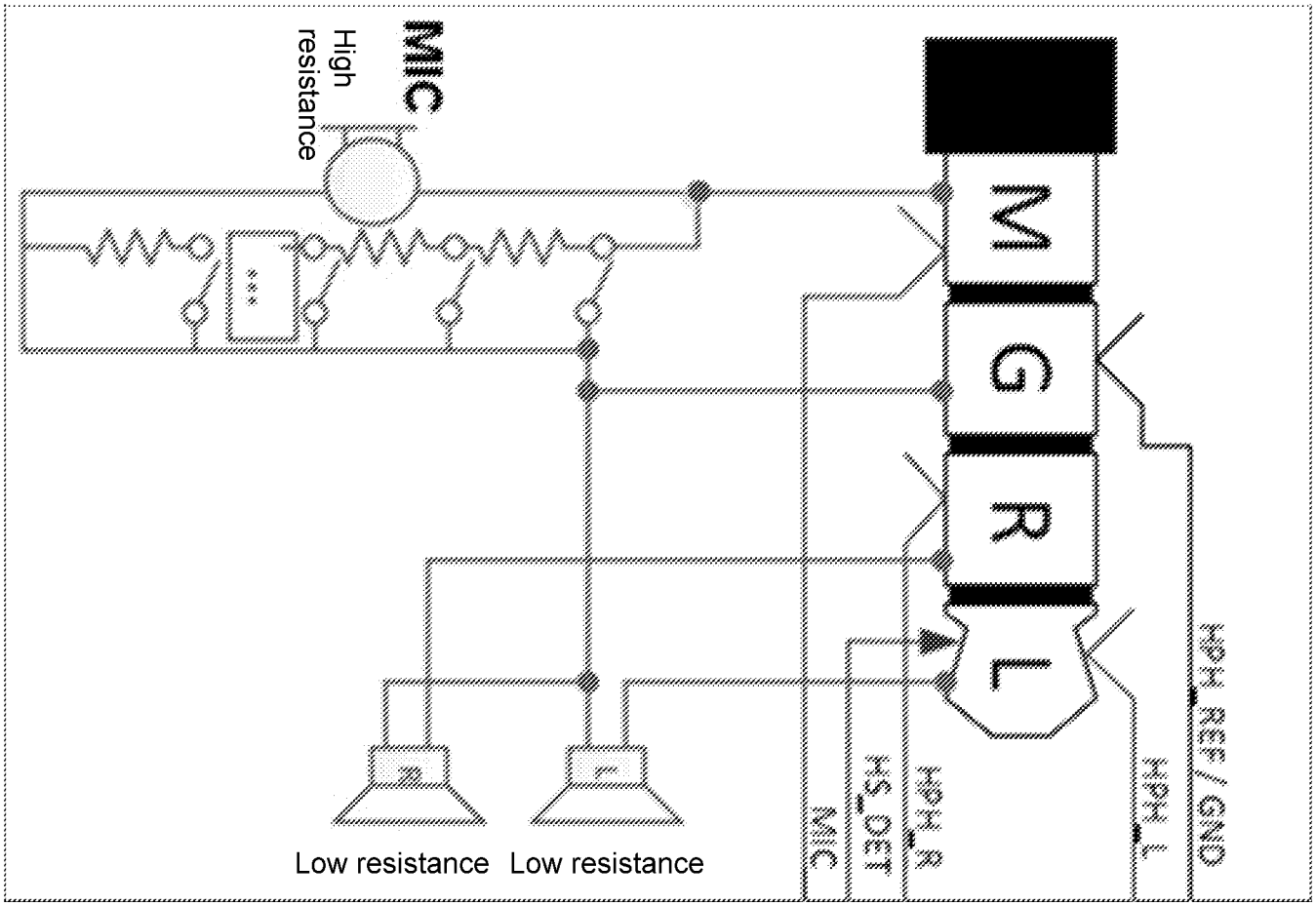
FIG. 3 is an internal principle diagram of an earphone body according to an embodiment of the disclosure.

FIG. 3 is an internal principle diagram of an earphone body according to an embodiment of the disclosure. As shown in FIG. 3, regardless of a European standard earphone or an American standard earphone, impedance between an L (left sound channel)/R (right sound channel) area and a GND area is very low, and is approximately considered to be short-circuit; and L (the left sound channel)/R (the right sound channel) and MIC are disconnected, and thus impedance therebetween is approximately considered to be infinitely high. The impedance between L or R and GND is low; while L or R and MIC are completely disconnected, and the impedance is infinitely high and approximate to that of an open circuit.

According to the embodiment of the disclosure, by virtue of such a characteristic of the earphone, a type of an earphone is determined on the basis of a detected current or voltage between a sound channel area and an adjacent area of the sound channel area, and GND and MIC of the earphone are connected with GND and MIC of an earphone system in an electronic device respectively according to the type of the earphone, to enable the earphone to work normally.

Figure 4:
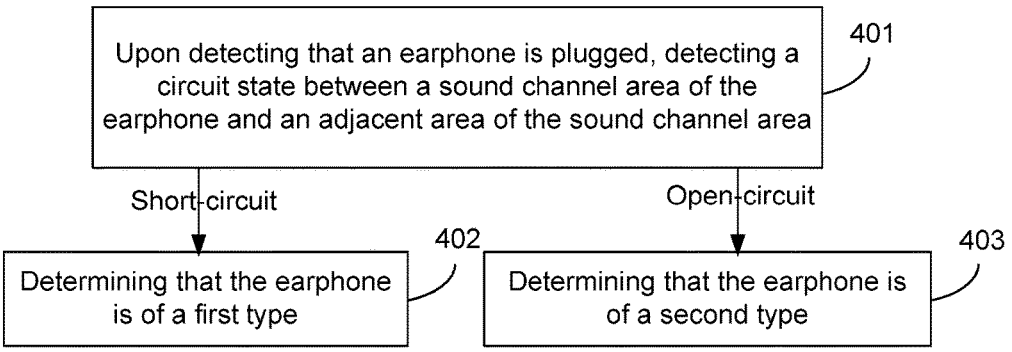
FIG. 4 is a flowchart of an earphone recognition method according to an embodiment of the disclosure.

FIG. 4 is a flowchart of an earphone recognition method according to an embodiment of the disclosure. As shown in FIG. 4, the earphone recognition method of the present embodiment includes the following steps 401 to 403.

In step 401, when it is detected that an earphone is plugged, a circuit state between a sound channel area of the earphone and an adjacent area of the sound channel area is detected.

In the embodiment of the disclosure, a voltage between the sound channel area of the earphone and the adjacent area of the sound channel area may be detected to determine the circuit state between the sound channel area of the earphone and the adjacent area of the sound channel area; or, a current between the sound channel area of the earphone and the adjacent area of the sound channel area may be detected to determine the circuit state between the sound channel area of the earphone and the adjacent area of the sound channel area.

In step 402, it is determined that the earphone is of a first type when the circuit state between the sound channel area of the earphone and the adjacent area of the sound channel area is a short-circuit state.

Short circuit between the sound channel area of the earphone and its adjacent area means that the adjacent area of the sound channel area is a GND area, the earphone of this type is an American standard earphone and a leftmost end of the earphone is an MIC area. At this moment, a first indication signal is output.

In step 403, it is determined determining that the earphone is of a second type of when the circuit state between the sound channel area of the earphone and the adjacent area of the sound channel area is an open-circuit state.

Open circuit between the sound channel area of the earphone and its adjacent area means that the adjacent area of the sound channel area is the MIC area, the earphone of this type is a European standard earphone and the leftmost end of the earphone is the GND area. At this moment, a second indication signal is output.

Figure 5:
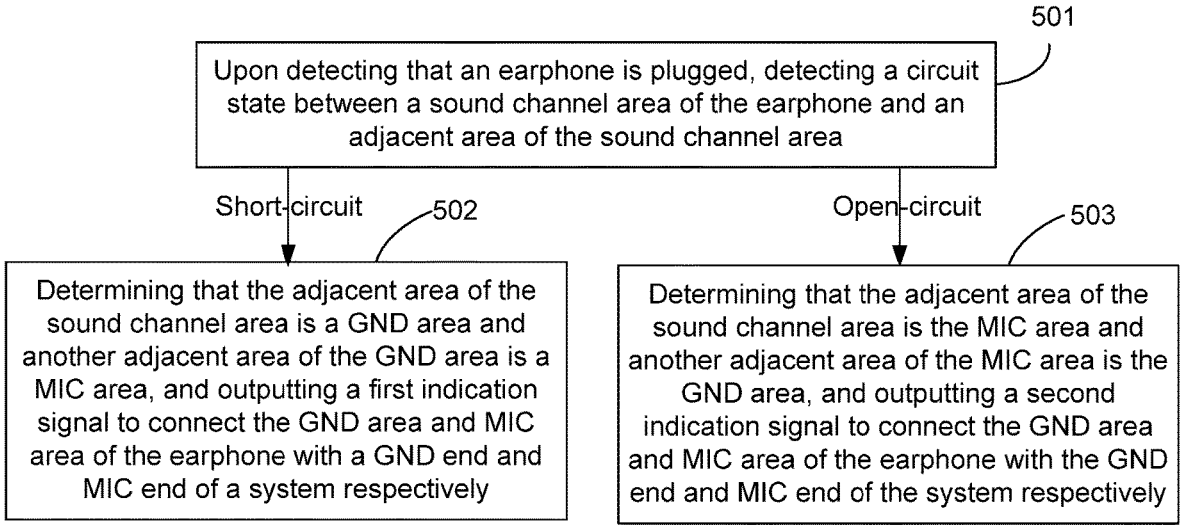
FIG. 5 is a flowchart of an earphone connection method according to an embodiment of the disclosure.

FIG. 5 is a flowchart of an earphone connection method according to an embodiment of the disclosure. As shown in FIG. 5, the earphone connection method of the present embodiment includes the following steps 501 to 503.

In step 501, when it is detected that an earphone is plugged, a circuit state between a sound channel area of the earphone and an adjacent area of the sound channel area is detected.

In step 502, when the circuit state between the sound channel area of the earphone and the adjacent area of the sound channel area is a short-circuit state, it is determined that the adjacent area of the sound channel area is a GND area and another adjacent area of the GND area is a MIC area, and a first indication signal is output, such that the GND area and MIC area of the earphone are connected with a GND end and MIC end of a system respectively.

Short circuit between the sound channel area of the earphone and its adjacent area means that the adjacent area of the sound channel area is the GND area, the earphone of this type is an American standard earphone and a leftmost end of the earphone is the MIC area. At this moment, the first indication signal is output.

In Step 503, when the circuit state between the sound channel area of the earphone and the adjacent area of the sound channel area is an open-circuit state, it is determined that the adjacent area of the sound channel area is the MIC area and another adjacent area of the MIC area is the GND area, and a second indication signal is output, such that the GND area and MIC area of the earphone are connected with the GND end and MIC end of the system respectively.

Open circuit between the sound channel area of the earphone and its adjacent area means that the adjacent area of the sound channel area is the MIC area, the earphone of this type is a European standard earphone and the leftmost end of the earphone is the GND area. At this moment, the second indication signal is output.

An embodiment of the disclosure provides an earphone recognition circuit, which includes a detection power supply, a first resistor, a second resistor and a third resistor, which are sequentially connected in series, and the third resistor is grounded; a sound channel area of the earphone is connected to a circuit between the second resistor and the third resistor; an adjacent area of the sound channel area of the earphone is connected to a circuit between the first resistor and the second resistor.

A resistance value of the second resistor is higher than a resistance value of the first resistor, and the resistance value of the first resistor is higher than a resistance value of the third resistor; the resistance value of the third resistor is higher than n times of impedance of the earphone; n is more than or equal to 10.

The earphone is determined to be of a first type when the circuit between the first resistor and the second resistor is at a low level, and the earphone is determined to be of a second type when the circuit between the first resistor and the second resistor is at a high level.

As a preferred solution, the circuit includes an indication signal output line.

One end of the indication signal output line is connected to the circuit between the first resistor and the second resistor, and the other end is an output end; and the output end outputs a level signal of the circuit between the first resistor and the second resistor.

An embodiment of the disclosure provides an earphone connection circuit, which includes a detection circuit and a switching circuit. The detection circuit includes a detection power supply, a first resistor, a second resistor, a third resistor and an indication signal output line, which are sequentially connected in series, and the third resistor is grounded; a sound channel area of an earphone is connected to a circuit between the second resistor and the third resistor; an adjacent area of the sound channel area of the earphone is connected to a circuit between the first resistor and the second resistor.

A resistance value of the second resistor is higher than a resistance value of the first resistor, and the resistance value of the first resistor is higher than a resistance value of the third resistor; the resistance value of the third resistor is higher than n times of impedance of the earphone; n is more than or equal to 10.

The switching circuit includes an indication signal receiving line, a first switch and a second switch; one end of the first switch is connected with a GND end of a system, and other ends of the first switch are connected with an MIC area and GND area of the earphone respectively; one end of the second switch is connected with an MIC end of the system, and other ends of the second switch are connected with the MIC area and GND area of the earphone respectively.

One end of the indication signal output line is connected to the circuit between the first resistor and the second resistor, the other end of the indication signal output line is connected with an input end of the indication signal receiving line, and an output end of the indication signal receiving line is connected with both the first switch and the second switch.

When the circuit between the first resistor and the second resistor is at a low level, it is determined that the adjacent area of the sound channel area is the GND area and another adjacent area of the GND area is the MIC area, the indication signal output line outputs a low level signal to the indication signal receiving line, and the low level signal controls the first switch to gate the GND end of the system and the GND area of the earphone and controls the second switch to gate the MIC end of the system and the MIC area of the earphone; and when the circuit between the first resistor and the second resistor is at a high level, it is determined that the adjacent area of the sound channel area is the MIC area and another adjacent area of the MIC area is the GND area, the indication signal output line outputs a high level signal to the indication signal receiving line, and the high level signal controls the first switch to gate the GND end of the system and the GND area of the earphone and controls the second switch to gate the MIC end of the system and the MIC area of the earphone.

As a preferred solution, the earphone is determined to be of a first type when the circuit between the first resistor and the second resistor is at a low level.

The earphone is determined to be of a second type when the circuit between the first resistor and the second resistor is at a high level.

The subject matter of the technical solutions of the embodiments of the disclosure will be further elaborated below with specific examples.

Figure 6:
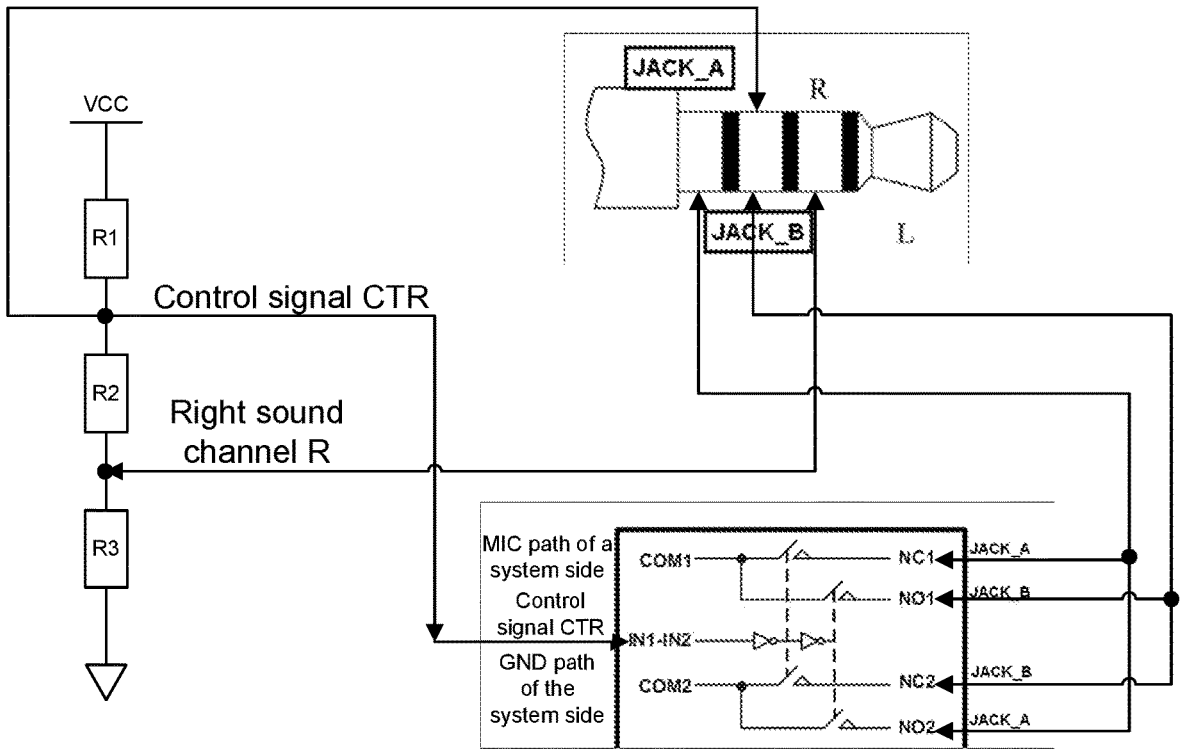
FIG. 6 is a first implementation principle diagram of an earphone connection circuit according to an embodiment of the disclosure.

FIG. 6 is a first implementation principle diagram of an earphone connection circuit according to an embodiment of the disclosure. Referring to FIG. 6, in the embodiment of the disclosure, a switching circuit (shown in box at a lower part in FIG. 6) is used, and a COM1 end is connected with an MIC path of a system side; an NO1 end is connected with a third stage (close to R) of an earphone socket, and is named after JACK_B; and an NC1 end is connected with a fourth stage (a final stage) of the earphone socket, and is named after JACK_A.

A COM2 end is connected with a GND path of the system side; an NC2 end is connected with the third stage (close to R) of the earphone socket, and is named after JACK_B; and an NO2 end is connected with the fourth stage (the final stage) of the earphone socket, and is named after JACK_A.

A Current Transmission Rate (CTR) signal controls the switching circuit, and when the CTR signal is at a high level, COM is connected with NO (including NO1 and NO2); and when the CTR signal is at a low level, COM is connected with NC (including NC1 and NC2).

Figure 7:
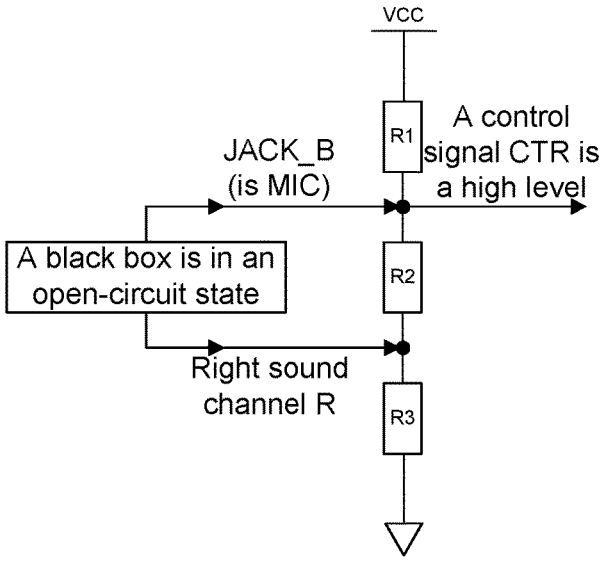
FIG. 7 is a first principle diagram of an earphone recognition circuit according to an embodiment of the disclosure.
Figure 8:
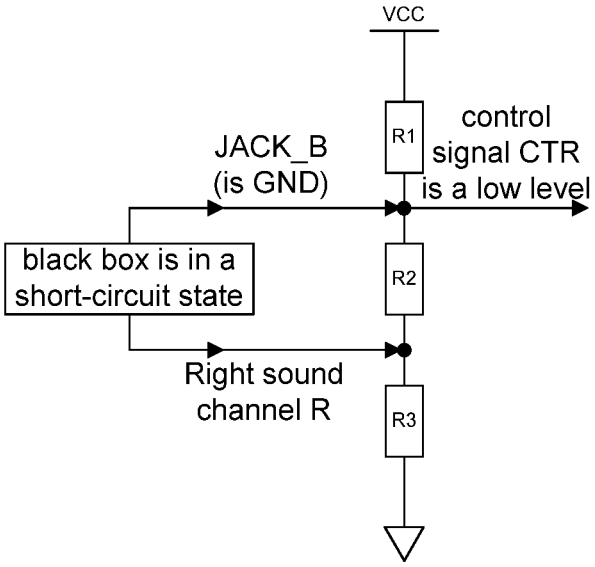
FIG. 8 is a second principle diagram of an earphone recognition circuit according to an embodiment of the disclosure.

FIG. 7 is a first principle diagram of an earphone recognition circuit according to an embodiment of the disclosure, and FIG. 8 is a second principle diagram of an earphone recognition circuit according to an embodiment of the disclosure. As shown in FIG. 7 and FIG. 8, the earphone recognition circuit of the embodiment of the disclosure is implemented by using three resistors R1, R2 and R3, where the impedance of R2 is highest, the impedance of R3 is lowest, and the impedance of R1 is between the impedance of R2 and the impedance of R3. The three resistors are connected in series, one end is connected with a power supply, and the other end is grounded. JACK_B is led to a junction between R1 and R2; and the sound channel R is led to a junction between R2 and R3. In addition, the CTR signal is led from the junction between R1 and R2.

In the embodiment of the disclosure, the three resistors are selected according to the following principles.

First of all, the impedances of R1, R2 and R3 are medium, high and low respectively. As shown in FIG. 7, in case of open circuit of the black box, a high level approximate to a Volt Current Condenser (VCC) may be output (i.e. a CTR) at the junction between R1 and R2. For example, when the VCC is 1.8V, the CTR is not greater than 1.8V-0.1 VCC.

In case of short-circuit of the black box, a low level approximate to a level 0 may be output (i.e. the CTR) at the junction between R1 and R2, and when the VCC is 1.8V, the CTR is not greater than 0V+0.1 VCC.

Secondly, the impedances of R1, R2 and R3 are greater than impedance of an earphone body of the sound channel R or the sound channel L by several magnitude orders. That is, R2 is higher than a resistance value of R1, and the resistance value of R1 is higher than a resistance value of R3; the resistance value of R3 is higher than n times of the impedance of the earphone; and n is more than or equal to 10.

Further, the impedances of R1, R2 and R3 may not be infinitely high. In other words, the impedances of R1, R2 and R3 are recognizable compared with open circuit.

Furthermore, the resistance value of R1 may not be excessively low. If JACK_B is GND and there is only R1 between the power supply VCC and the ground, at this moment, for ensuring relatively lower power consumption of a system, the value of R1 may not be excessively low. For example, R1 is selected to be 50 K, the VCC is 1.8V and the power consumption of the system is 36 microamperes.

Finally, the resistance value of R3 is greater than that of the earphone body by several magnitude orders. When the earphone of the sound channel R works normally, the circuit between R3 and the ground is nearly an open circuit compared to the circuit of the sound channel R. For example, the impedance of the earphone body is 16Ω, the impedance of R3 is 5 KΩ, and if the earphone body works at this moment, R3 has no influence on normal work of the earphone of the sound channel R.

In the embodiment of the disclosure, the power supply VCC is selected according to the following principles.

First of all, the high level is matched with a level of a CTR end of a switching circuit.

Secondly, the VCC is kept consistent with a bias power level of an MIC circuit when the system works. If JACK_B is the MIC, the MIC may work with power of the same level, so that it may ensure that the MIC circuit works normally.

When JACK_B is the MIC, since a circuit between the MIC and sound channel R in the earphone body is open, as shown in a left part in FIG. 7, the black circuit is an open circuit. The earphone recognition circuit CTR outputs a high level.

When JACK_B is the GND, since a circuit between the GND and sound channel R in the earphone body is nearly a short circuit, as shown in FIG. 8, the black box is a short circuit. The earphone recognition circuit CTR outputs a low level.

Figure 9:
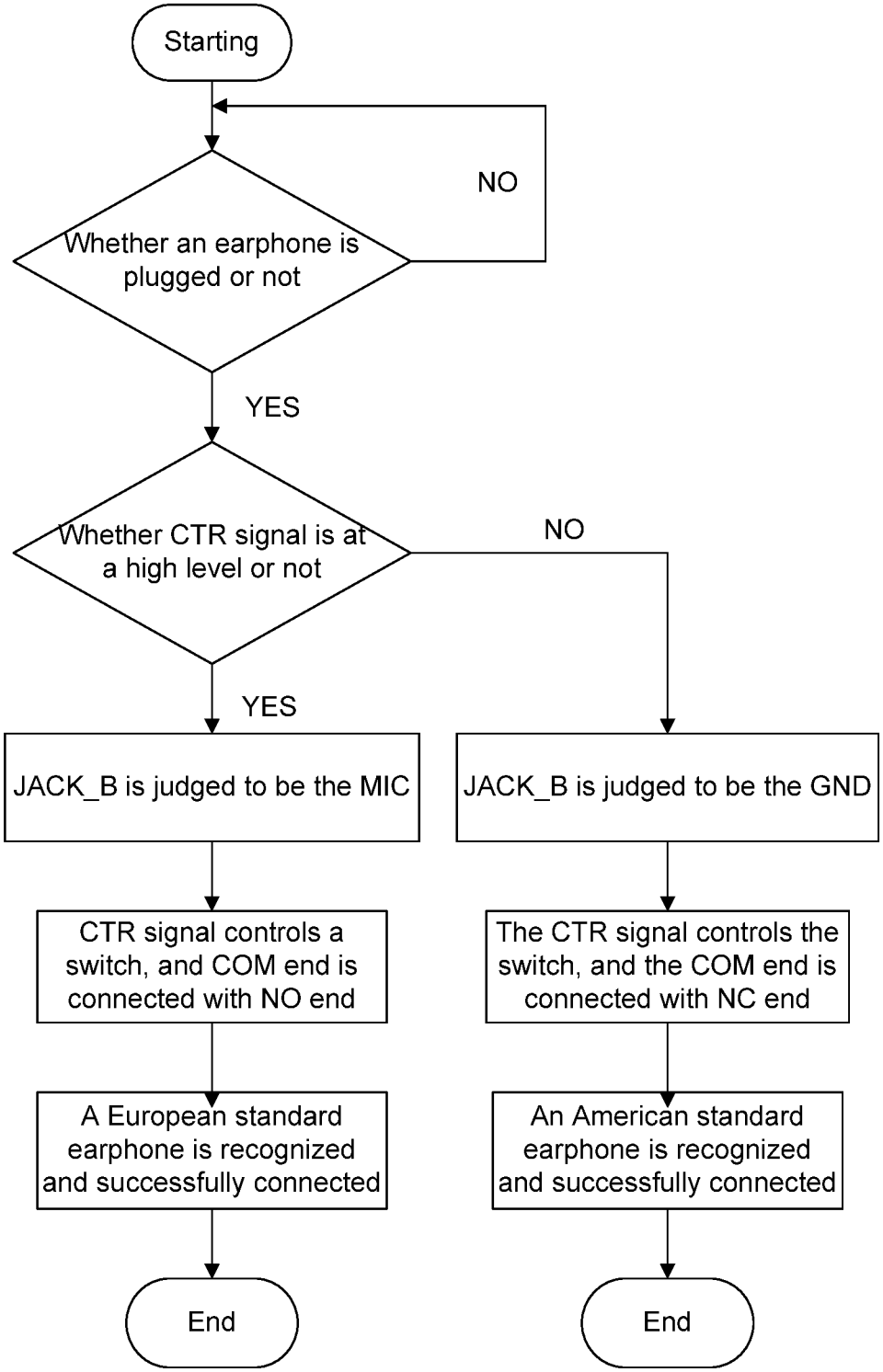
FIG. 9 is a flowchart of earphone connection according to an embodiment of the disclosure.

FIG. 9 is a flowchart of earphone connection according to an embodiment of the disclosure. As shown in FIG. 9, the earphone connection flow of the embodiment includes the following steps.

It is detected whether there is an earphone plugged or not.

If NO, the system continues waiting for a plugging operation of the earphone.

If the earphone is plugged, the earphone recognition circuit performs earphone type recognition.

When JACK_B is the MIC, since the circuit between the MIC and sound channel R in the earphone body is open, as shown in the left part in FIG. 7, the black circuit is an open circuit. The earphone recognition circuit CTR outputs the high level. The earphone is a European standard earphone.

When JACK_B is the GND, since the circuit between the GND and sound channel R in the earphone body is nearly a short circuit, as shown in FIG. 8, the black box is a short circuit. The earphone recognition circuit CTR outputs the low level. The earphone is an American standard earphone.

It is judged whether the CTR outputs the high level or not.

If the CTR outputs the high level, JACK_B is the MIC.

If the CTR outputs the low level, JACK_B is the GND.

When it is judged that JACK_B is the MIC, the CTR signal is the high level.

Then, the high level of the CTR controls the switching circuit to perform the following operations.

COM1 is connected with NO1. The COM1 end is connected with the MIC path of the system side; and the NO1 end is connected with the third stage (close to R) of the earphone socket, and is named after JACK_B. Accurate recognition and connection of the MIC path is implemented.

COM2 is connected with NO2. The COM2 end is connected with the GND path of the system side; and the NO2 end is connected with the fourth stage (the final stage) of the earphone socket, and is named after JACK_A. Accurate recognition and connection of the GND path is implemented.

Next, accurate recognition and connection of a MIC signal and a GND signal is achieved. The European standard earphone is connected and recognized.

When the system judges that JACK_B is the GND, the CTR signal is the low level.

Then, the low level of the CTR controls the switching circuit to perform the following operations.

COM1 is connected with NC1. The COM1 end is connected with the MIC path of the system side; and the NC1 end is connected with the fourth stage (the final stage) of the earphone socket, and is named after JACK_A. Accurate recognition and connection of the MIC path is implemented.

COM2 is connected with NC2. The COM2 end is connected with the GND path of the system side; and the NO2 end is connected with the third stage (close to R) of the earphone socket, and is named after JACK_B. Accurate recognition and connection of the GND path is implemented.

Finally, accurate recognition and connection of the MIC signal and the GND signal is achieved. The American standard earphone is connected and recognized.

Figure 10:
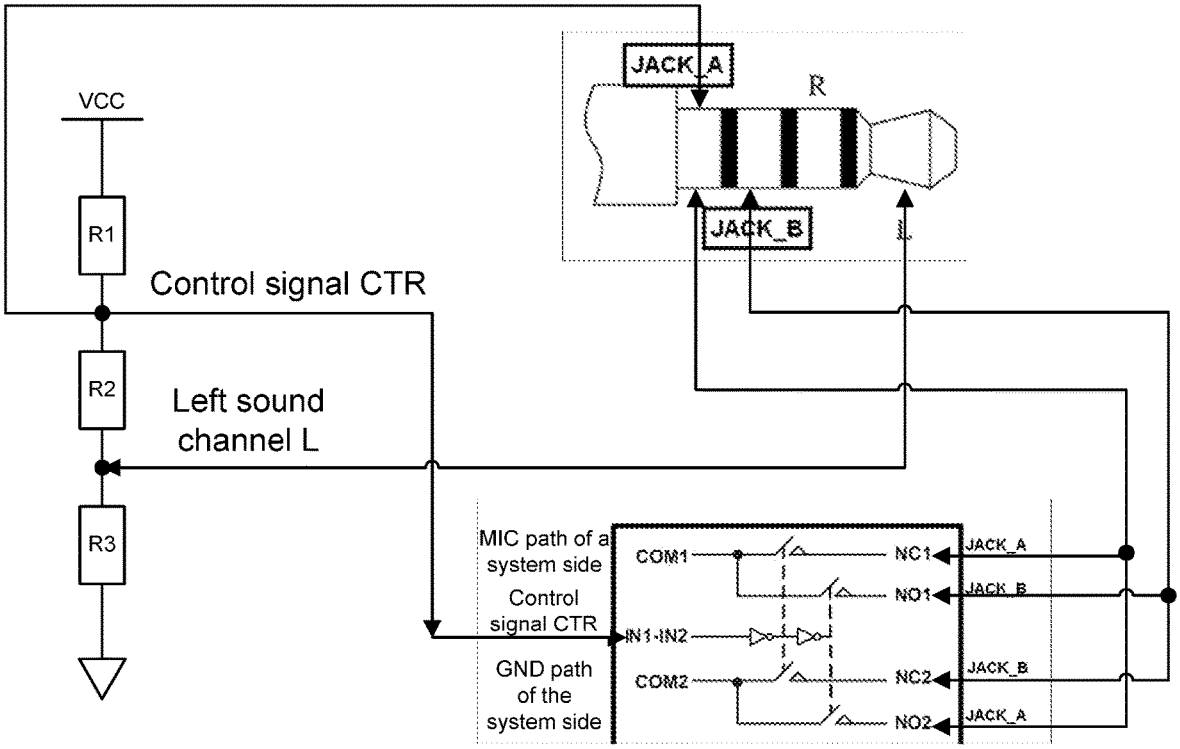
FIG. 10 is a second implementation principle diagram of an earphone connection circuit according to an embodiment of the disclosure.

FIG. 10 is a second implementation principle diagram of an earphone connection circuit according to an embodiment of the disclosure. As shown in FIG. 10, in the example, a COM1 end in a switching circuit is connected with a MIC path of a system side; an NO1 end is connected with a third stage (close to R) of an earphone socket, and is named after JACK_B; and an NC1 end is connected with a fourth stage (a final stage) of the earphone socket, and is named after JACK_A.

A COM2 end is connected with a GND path of the system side; an NC2 end is connected with the third stage (close to R) of the earphone socket, and is named after JACK_B; and an NO2 end is connected with the fourth stage (the final stage) of the earphone socket, and is named after JACK_A.

A CTR signal controls the switching circuit, and when the CTR signal is at a high level, COM is connected with NO; and when the CTR signal is at a low level, COM is connected with NC.

In the example, three resistors are used in the earphone recognition circuit, impedances of R2 is highest, impedance of R3 is lowest, and impedance of R1 is between those of R2 and R3. The three resistors are connected in series, one end is connected with a power supply, and the other end is grounded. JACK_B is led to a junction between R1 and R2; and a sound channel R is led to a junction between R2 and R3. In addition, the CTR signal is led from the junction between R1 and R2.

Then, JACK_A is led to the junction between R1 and R2. A sound channel L is led to the junction between R2 and R3.

When JACK_A is the MIC, since a circuit between the MIC and sound channel L in an earphone body is an open circuit, the earphone recognition circuit CTR outputs a high level.

When JACK_A is the GND, since a circuit between the GND and sound channel L in the earphone body is nearly a short circuit, the earphone recognition circuit CTR outputs a low level.

When the system judges that JACK_A is the MIC, the CTR signal is at the high level.

Next, the high level of the CTR controls the switching circuit to perform the following operations.

COM1 is connected with NC1. The COM1 end is connected with the MIC path of the system side; and the NC1 end is connected with the fourth stage (the final stage) of the earphone socket, and is named after JACK_A. Accurate recognition and connection of the MIC path is implemented.

COM2 is connected with NC2. The COM2 end is connected with the GND path of the system side; and the NC2 end is connected with the third stage (close to R) of the earphone socket, and is named after JACK_B. Accurate recognition and connection of the GND path is implemented.

Later on, accurate recognition and connection of a MIC signal and a GND signal is achieved. An American standard earphone is connected and recognized.

When the system judges that JACK_A is the GND, the CTR signal is at the low level.

Then, the low level of the CTR controls the switching circuit to perform the following operations.

COM1 is connected with NO1. The COM1 end is connected with the GND path of the system side; and the NO1 end is connected with the third stage (close to R) of the earphone socket, and is named after JACK_B. Accurate recognition and connection of the MIC path is implemented.

COM2 is connected with NO2. The COM2 end is connected with the MIC path of the system side; and the NO2 end is connected with the fourth stage (the final stage) of the earphone socket, and is named after JACK_A. Accurate recognition and connection of the GND path is implemented.

Finally, accurate recognition and connection of the MIC signal and the GND signal is achieved. A European standard earphone is connected and recognized.

Figure 11:
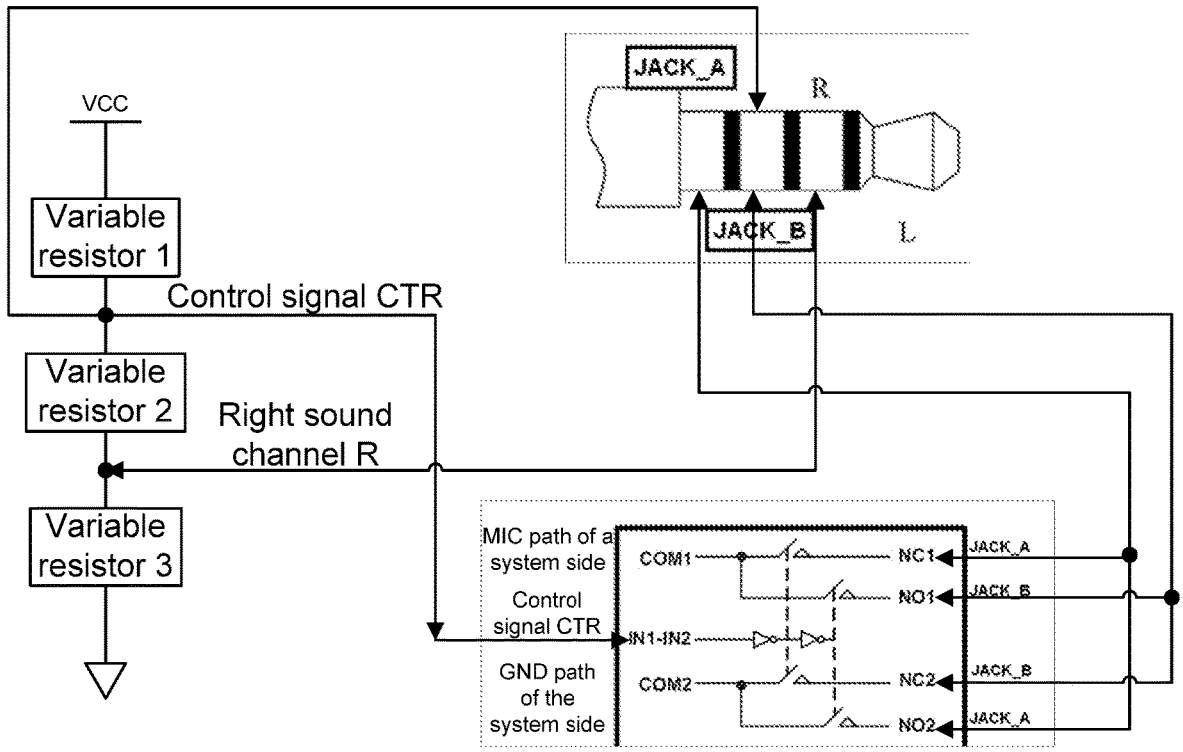
FIG. 11 is a third implementation principle diagram of an earphone connection circuit according to an embodiment of the disclosure.

FIG. 11 is a third implementation principle diagram of an earphone connection circuit according to an embodiment of the disclosure. As shown in FIG. 11, in the example, a COM1 end of a switching circuit is connected with a MIC path of a system side; an NO1 end is connected with a third stage (close to R) of an earphone socket, and is named after JACK_B; and an NC1 end is connected with a fourth stage (a final stage) of the earphone socket, and is named after JACK_A.

A COM2 end is connected with a GND path of the system side; an NC2 end is connected with the third stage (close to R) of the earphone socket, and is named after JACK_B; and an NO2 end is connected with the fourth stage (the final stage) of the earphone socket, and is named after JACK_A.

A CTR signal controls the switching circuit, and when the CTR signal is at a high level, COM is connected with NO; and when the CTR signal is at a low level, COM is connected with NC.

Three variable resistors are used in the earphone recognition circuit of the embodiment. The three resistors are connected in series, one end is connected with a power supply, and the other end is grounded. JACK_B is led to a junction between the variable resistor 1 and the variable resistor 2; and a sound channel R is led to a junction between the variable resistor 2 and the variable resistor 3. In addition, the CTR signal is led from the junction between the variable resistor 1 and the variable resistor 2.

JACK_A is led to the junction between the variable resistor 1 and the variable resistor 2. A sound channel L is led to the junction between the variable resistor 2 and the variable resistor 3.

Resistance values of the three variable resistors may be regulated according to a practical circuit condition. For example, impedance of the variable resistor 2 may be highest, impedance of the variable resistor 3 may be lowest, and impedance of the variable resistor 1 may be between those of the variable resistor 2 and the variable resistor 3.

When JACK_B is the MIC, since a circuit between the MIC and sound channel R in an earphone body is an open circuit, the earphone recognition circuit CTR outputs a high level.

When JACK_B is the GND, since a circuit between the GND and sound channel R in the earphone body is nearly a short circuit, the earphone recognition circuit CTR outputs a low level.

When the system judges that JACK_B is the MIC, the CTR signal is at the high level.

Next, the high level of the CTR controls the switching circuit to perform the following operations.

COM1 is connected with NO1. The COM1 end is connected with the MIC path of the system side; and the NO1 end is connected with the third stage (close to R) of the earphone socket, and is named after JACK_B. Accurate recognition and connection of the MIC path is implemented.

COM2 is connected with NO2. The COM2 end is connected with the GND path of the system side; and the NO2 end is connected with the fourth stage (the final stage) of the earphone socket, and is named after JACK_A. Accurate recognition and connection of the GND path is implemented.

Later on, accurate recognition and connection of a MIC signal and a GND signal is achieved. A European standard earphone is connected and recognized.

When the system judges that JACK_B is the GND, the CTR signal is at the low level.

Then, the low level of the CTR controls the switching circuit to perform the following operations.

COM1 is connected with NC1. The COM1 end is connected with the MIC path of the system side; and the NC1 end is connected with the fourth stage (the final stage) of the earphone socket, and is named after JACK_A. Accurate recognition and connection of the MIC path is implemented.

COM2 is connected with NC2. The COM2 end is connected with the GND path of the system side; and the NO2 end is connected with the third stage (close to R) of the earphone socket, and is named after JACK_B. Accurate recognition and connection of the GND path is implemented.

Finally, accurate recognition and connection of the MIC signal and the GND signal is achieved. An American standard earphone is connected and recognized.

An embodiment of the disclosure provides a storage medium, in which a computer program is stored, the computer program is arranged to execute the earphone recognition method of each abovementioned embodiment.

An embodiment of the disclosure provides a storage medium, in which a computer program is stored, the computer program is arranged to execute the earphone connection method of each abovementioned embodiment.

The technical solutions of the embodiments of the disclosure may be combined on the premise of no conflicts.

In some embodiments provided by the disclosure, it should be understood that the disclosed method and intelligent device may be implemented in another manner. The device embodiment described above is only schematic. For example, division of the units is only logic function division, and other division manners may be adopted during practical implementation. For example, multiple units or components may be combined or integrated into another system, or some characteristics may be neglected or not executed. In addition, coupling, or direct coupling or communication connection between each displayed or discussed component may be indirect coupling or communication connection, implemented through some interfaces, of the device or the units, and may be electrical and mechanical or adopt other forms.

The units described as separate parts may or may not be physically separated, and parts displayed as units may or may not be physical units, and namely may be located in the same place, or may also be distributed to multiple network units. Part or all of the units may be selected to achieve the purpose of the solutions of the embodiments according to a practical requirement.

In addition, each function unit in each embodiment of the disclosure may be integrated into a processing unit, each unit may also exist independently, and two or more than two units may also be integrated into a unit. The abovementioned integrated unit may be implemented in a hardware form, and may also be implemented in form of hardware and software function unit.

Those skilled in the art should know that: all or part of the steps of the abovementioned method embodiments may be implemented by instructing related hardware through an application, the abovementioned application may be stored in a computer-readable storage medium, and the application is executed to execute the steps of the abovementioned method embodiments; and the storage medium includes: various media capable of storing application codes such as a mobile storage device, a Read-Only Memory (ROM), a Random Access Memory (RAM), a magnetic disk or an optical disk.

Or, when being implemented in form of software function module and sold or used as an independent product, the integrated unit of the embodiments of the disclosure may also be stored in a computer-readable storage medium. Based on such an understanding, the technical solutions of the embodiments of the disclosure substantially or parts making contributions to the conventional art may be embodied in form of software product, and the computer software product is stored in a storage medium, including a plurality of instructions configured to enable a computer device (which may be a personal computer, a server, a network device or the like) to execute all or part of the methods in each embodiment of the disclosure. The abovementioned storage medium includes: various media capable of storing application codes such as a mobile storage device, a ROM, a RAM, a magnetic disk or an optical disk.

The above is only the specific implementation mode of the disclosure and not intended to limit the scope of protection of the disclosure. Any variations or replacements apparent to those skilled in the art within the technical scope disclosed by the disclosure shall fall within the scope of protection of the disclosure.

INDUSTRIAL APPLICABILITY

According to the disclosure, the GND area and MIC area of the earphone are determined by detecting the circuit state between the sound channel area and the adjacent area of the sound channel area of the earphone, and the GND area and MIC area of the earphone are butted with the GND end and MIC end of the earphone system in the electronic device respectively to make the earphone enter a working state.

What is claimed is:

1. An earphone recognition method, the method comprising:

upon detecting that an earphone is plugged, only detecting a circuit state between a sound channel area of the earphone and one adjacent area of the sound channel area, determining that the earphone is of a first type, when the circuit state between the sound channel area of the earphone and the adjacent area of the sound channel area is a short-circuit state, and determining that the earphone is of a second type, when the circuit state between the sound channel area of the earphone and the adjacent area of the sound channel area is an open-circuit state.

2. The method according to claim 1, wherein the method further comprises:

when the circuit state between the sound channel area of the earphone and the adjacent area of the sound channel area is the short-circuit state, determining that the adjacent area of the sound channel area is a Ground (GND) area and another adjacent area of the GND area is a Microphone (MIC) area; and when the circuit state between the sound channel area of the earphone and the adjacent area of the sound channel area is the open-circuit state, determining that the adjacent area of the sound channel area is the MIC area and another adjacent area of the MIC area is the GND area.

3. The method according to claim 2, wherein the method further comprises:

when the circuit state between the sound channel area of the earphone and the adjacent area of the sound channel area is the short-circuit state, outputting a first indication signal; and when the circuit state between the sound channel area of the earphone and the adjacent area of the sound channel area is the open-circuit state, outputting a second indication signal.

4. The method according to claim 1, wherein detecting the circuit state between the sound channel area of the earphone and the adjacent area of the sound channel area comprises:

detecting a voltage between the sound channel area of the earphone and the adjacent area of the sound channel area to determine the circuit state between the sound channel area of the earphone and the adjacent area of the sound channel area; or detecting a current between the sound channel area of the earphone and the adjacent area of the sound channel area to determine the circuit state between the sound channel area of the earphone and the adjacent area of the sound channel area.

5. An earphone connection method, the method comprising:

upon detecting that an earphone is plugged, only detecting a circuit state between a sound channel area of the earphone and one adjacent area of the sound channel area;

when the circuit state between the sound channel area of the earphone and the adjacent area of the sound channel area is a short-circuit state, determining that the adjacent area of the sound channel area is a Ground (GND) area and another adjacent area of the GND area is a Microphone (MIC) area, and outputting a first indication signal to cause the GND area and MIC area of the earphone to be connected with a GND end and MIC end of a system respectively; and when the circuit state between the sound channel area of the earphone and the adjacent area of the sound channel area is an open-circuit state, determining that the adjacent area of the sound channel area is the MIC area and another adjacent area of the MIC area is the GND area, and outputting a second indication signal to cause the GND area and MIC area of the earphone to be connected with the GND end and MIC end of the system respectively.

6. The method according to claim 5, wherein detecting the circuit state between the sound channel area of the earphone and the adjacent area of the sound channel area comprises:

detecting a voltage between the sound channel area of the earphone and the adjacent area of the sound channel area to determine the circuit state between the sound channel area of the earphone and the adjacent area of the sound channel area; or detecting a current between the sound channel area of the earphone and the adjacent area of the sound channel area to determine the circuit state between the sound channel area of the earphone and the adjacent area of the sound channel area.

7. An earphone recognition circuit, comprising: a detection power supply, a first resistor, a second resistor and a third resistor, wherein the detection power supply, the first resistor, the second resistor and the third resistor are sequentially connected in series, and the third resistor is grounded; a sound channel area of an earphone is connected to a circuit between the second resistor and the third resistor; an adjacent area of the sound channel area of the earphone is connected to a circuit between the first resistor and the second resistor;

a resistance value of the second resistor is higher than a resistance value of the first resistor, and the resistance value of the first resistor is higher than a resistance value of the third resistor; the resistance value of the third resistor is higher than n times of impedance of the earphone; n is more than or equal to 10; and the earphone is determined to be of a first type when the circuit between the first resistor and the second resistor is at a low level, and the earphone is determined to be of a second type when the circuit between the first resistor and the second resistor is at a high level.

8. The circuit according to claim 7, wherein the circuit further comprises an indication signal output line;

wherein one end of the indication signal output line is connected to the circuit between the first resistor and the second resistor, and another end of the indication signal output line is an output end; and the output end outputs a level signal of the circuit between the first resistor and the second resistor.

9. An earphone connection circuit, comprising: a detection circuit and a switching circuit, wherein the detection circuit comprises a detection power supply, a first resistor, a second resistor, a third resistor and an indication signal output line, wherein the detection power supply, the first resistor, the second resistor and the third resistor are sequentially connected in series, and the third resistor is grounded; a sound channel area of an earphone is connected to a circuit between the second resistor and the third resistor; an adjacent area of the sound channel area of the earphone is connected to a circuit between the first resistor and the second resistor;

a resistance value of the second resistor is higher than a resistance value of the first resistor, and the resistance value of the first resistor is higher than a resistance value of the third resistor; the resistance value of the third resistor is higher than n times of impedance of the earphone; n is more than or equal to 10;

the switching circuit comprises an indication signal receiving line, a first switch and a second switch; one end of the first switch is connected with a Ground (GND) end of a system, and other ends of the first switch are connected with a Microphone (MIC) area and GND area of the earphone respectively; one end of the second switch is connected with a MIC end of the system, and other ends of the second switch are connected with the MIC area and GND area of the earphone respectively;

one end of the indication signal output line is connected to the circuit between the first resistor and the second resistor, another end of the indication signal output line is connected with an input end of the indication signal receiving line, and an output end of the indication signal receiving line is connected with the first switch and the second switch respectively;

when the circuit between the first resistor and the second resistor is at a low level, it is determined that the adjacent area of the sound channel area is the GND area and another adjacent area of the GND area is the MIC area, the indication signal output line outputs a low level signal to the indication signal receiving line, and the low level signal controls the first switch to gate the GND end of the system and the GND area of the earphone and controls the second switch to gate the MIC end of the system and the MIC area of the earphone; and when the circuit between the first resistor and the second resistor is at a high level, it is determined that the adjacent area of the sound channel area is the MIC area and another adjacent area of the MIC area is the GND area, the indication signal output line outputs a high level signal to the indication signal receiving line, and the high level signal controls the first switch to gate the GND end of the system and the GND area of the earphone and controls the second switch to gate the MIC end of the system and the MIC area of the earphone.

10. The circuit according to claim 9, wherein the earphone is determined to be of a first type when the circuit between the first resistor and the second resistor is at a low level; and the earphone is determined to be of a second type when the circuit between the first resistor and the second resistor is at a high level.

* * * * *